United States Patent [19]

Vegh

[11] 4,206,625

[45] Jun. 10, 1980

[54] METHOD AND APPARATUS FOR SHAPING A STRIP

[75] Inventor: George Vegh, Toronto, Canada

[73] Assignee: Gybro Industries Ltd.

[21] Appl. No.: 933,860

[22] Filed: Aug. 15, 1978

[51] Int. Cl.[2] ..... B21D 5/08

[52] U.S. Cl. ..... 72/181

[58] Field of Search ..... 72/181, 176, 182, 220, 72/177, 179, 178; 29/514, 779; 228/164, 147, 169; 113/116

[56] References Cited

U.S. PATENT DOCUMENTS

| | | | |
|---|---|---|---|
| 66,248 | 7/1862 | O'Kane | 72/274 |
| 1,823,489 | 9/1931 | Ridder | 72/274 |
| 2,786,435 | 3/1957 | Ellzey | 72/181 X |
| 2,982,331 | 5/1961 | Bouner | 72/182 |
| 2,986,193 | 5/1961 | Howell | 72/177 |
| 3,070,145 | 12/1962 | Maier, Jr. | 72/176 |
| 3,462,989 | 8/1969 | Fischer, Jr. | 72/181 X |
| 3,500,672 | 3/1970 | Weatherwax | 72/170 |
| 3,535,905 | 10/1970 | Frizell | 72/220 |
| 3,791,185 | 2/1974 | Knudson | 72/181 |

*Primary Examiner*—Milton S. Mehr
*Attorney, Agent, or Firm*—Alan Swabey; Robert Mitchell; Guy Houle

[57] ABSTRACT

A folded edge is formed in an elongated strip in a simple compact machine; the strip is fed through a plurality of spaced apart edge forming roller means while being maintained in vertically disposed position; in this way a simple means can be provided for supporting a coil of the strip for feeding to the roller means. In this way there can be readily and easily produced panels for buildings, for example, fascia and siding.

16 Claims, 14 Drawing Figures

FIG.5.
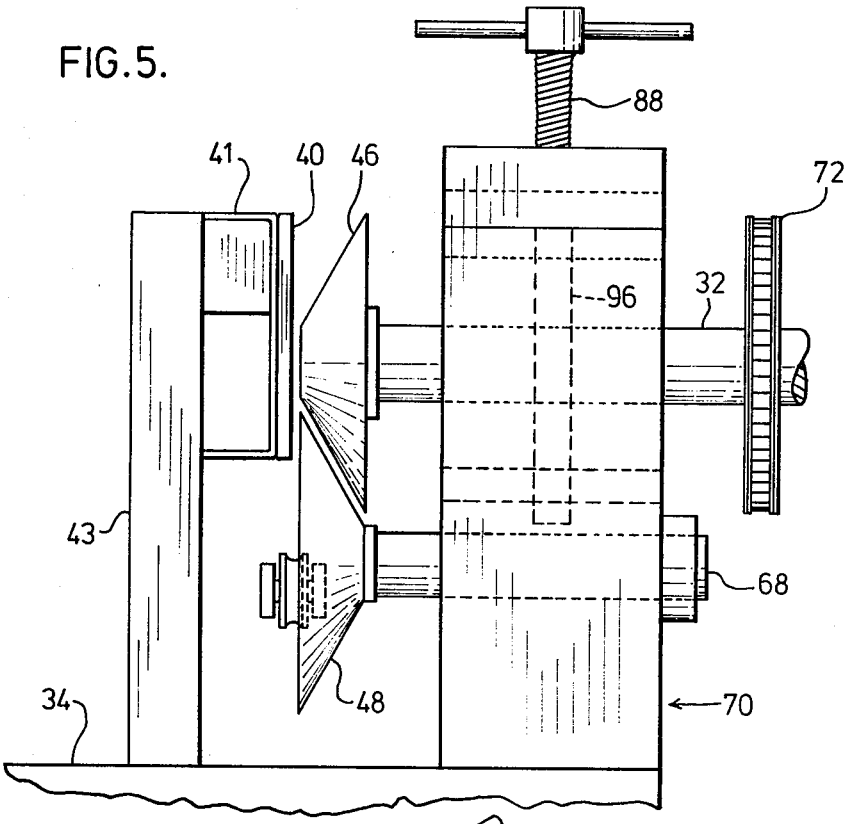
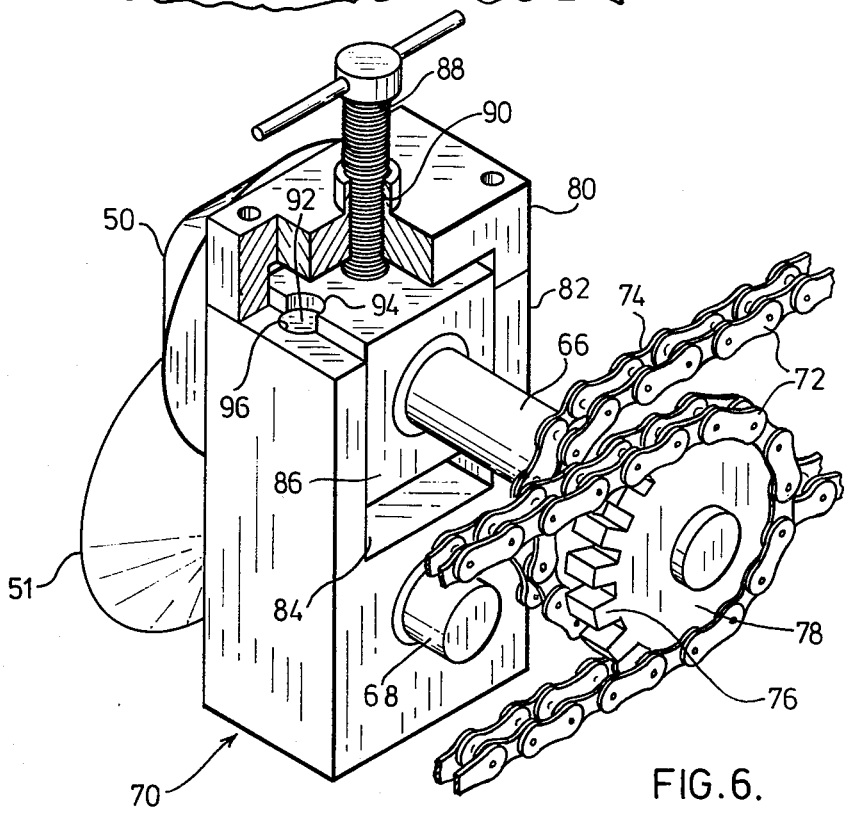
FIG.6.

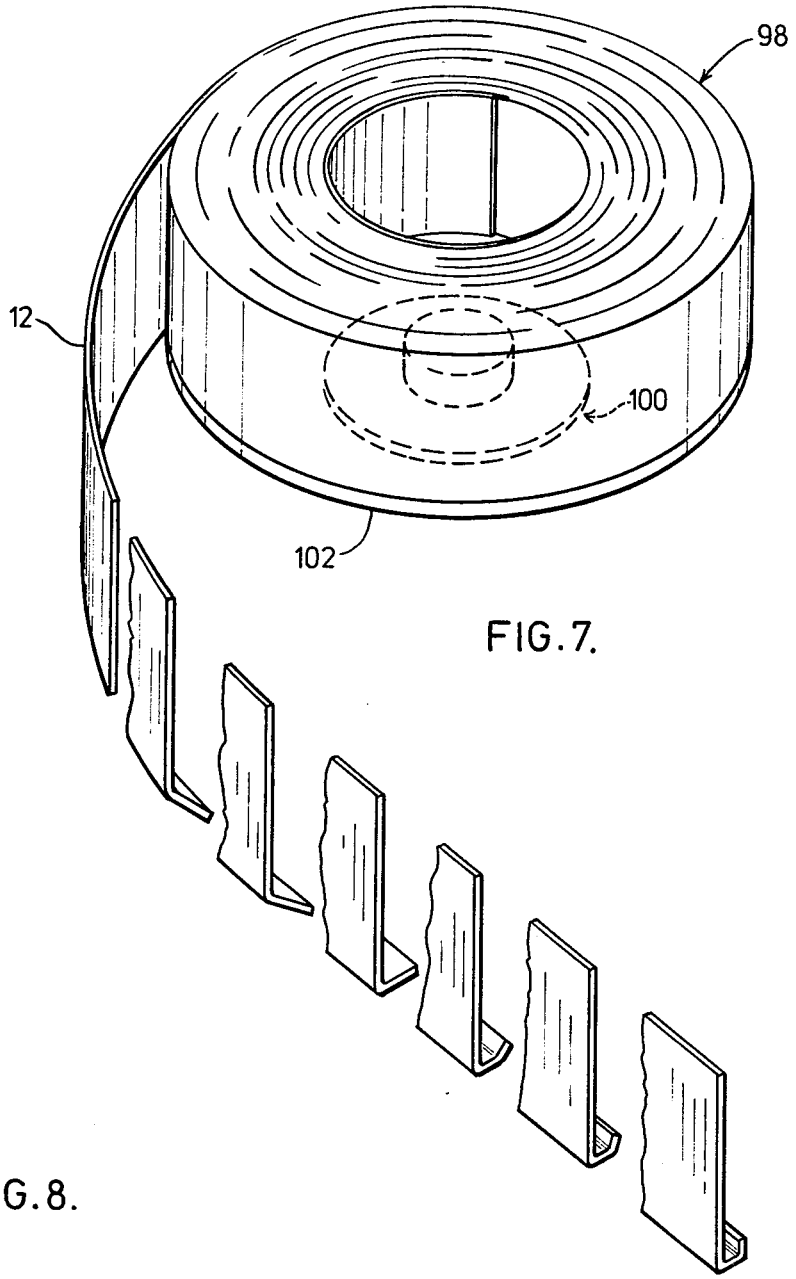
FIG. 7.
FIG. 8.
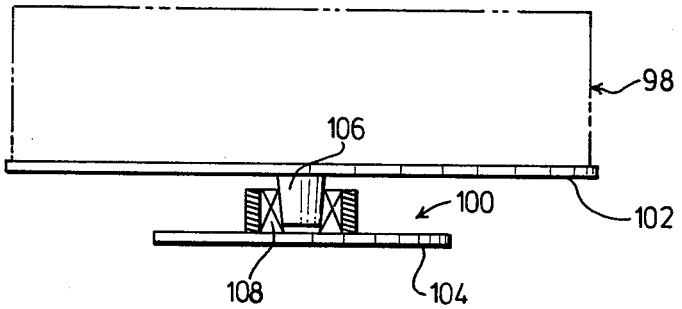

METHOD AND APPARATUS FOR SHAPING A STRIP

BACKGROUND OF THE INVENTION

1. Field of the Invention

This invention relates to the shaping of a generally flat material to produce a fold in one edge; more especially the invention is concerned with the shaping of sheet metal or the like into building panels.

2. Description of the prior Art

Panels made from aliminium or galvanized steel sheet material are widely employed in the building trade. Such panels, which are frequently painted, are employed to simulate wood panels.

Panels of this general type include siding panels and fascia panels.

Siding panels are disposed in a horizontal manner on the outside walls of frame buildings to form the exposed surface of the building and are typically nailed to vertical studs with or without intervening sheathing.

Fascia panels are employed under the eaves or cornice.

Such panels are usually made be feeding a strip of sheet material through a series of edge forming or shaping roller means. Each roller means comprises an upper roll and a lower roll which coact to engage the edge of the moving strip and impart a characteristic bend in the edge of the strip as part of the total shaping operation, so that when the strip has passed through all the roller means, the strip emerges with the desired fold along its edge.

The strip is fed from a coil horizontally through the roller means.

A machine of this general character is described in Canadian Pat. No. 983,366 of Gary A. Knudson. This machine is designed to form two operations, however, it can be employed solely to produce a shaped edge in an elongated strip, in which case the group A rollers described in the patent are employed alone, the group B rollers being disengaged.

Such a machine is employed at the site of the building on which the panels are being applied. The panelling is produced in a continual manner and cut, as it emerges from the machine, to the desired lengths to fit the building. Thus the machine is usually transported from site to site in a trailer and it is highly desirable to provide a compact portable machine that can be operated without special training or skill.

A particular problem with the machine described in the Canadian Patent resides in the mounting of the coil of sheet material for horizontal feeding through the shaping rollers.

In the embodiment described, and illustrated in FIG. 1, of the patent, the coil is mounted for rotation above the machine. This presents some problems since such a coil of aluminium may typically weigh about 380 to 400 lbs and a coil of galvanized steel weighs still more. In view of this it is necessary to employ a hoist to lift and mount the coil above the machine. If the coil is improperly placed or falls during mounting it may produce extensive and expensive damage to the machine parts below.

Although not shown in FIG. 1 of the aforementioned Canadian Patent, the commercial embodiment of the machine has a heavy upper supporting frame, extending the length of the machine, to support a hoist for lifting and mounting a coil above the machine. This considerably increases the size and cost of the machine, and necessitates a large trailer to house the machine.

The present invention has for an object the provision of a machine, which is both compact and portable, for forming a folded edge in an elongated strip of material; and especially for forming metal panels for buildings.

It is a further object of the invention to provide such a machine in which the necessity of mounting a coil of the sheet material is avoided, as are the structure and equipment for lifting, mounting and supporting the coil above the machine.

It is a still further object of the invention to provide such a machine which enables the use of a simple turntable to mount a coil of the sheet material, for feeding into the machine.

Another object of the invention is to provide a novel method of forming a folded edge in an elongated strip of material; and especially of forming metal building panels.

SUMMARY OF THE INVENTION

Broadly the invention comprises, in one aspect, an apparatus for forming a folded edge in an elongated strip of material, including a supporting structure, a plurality of edge forming roller means mounted in said supporting structure at spaced intervals along a path, and means for guiding an elongated strip of material, in a vertical disposition along said path.

In another aspect of the invention, broadly stated, there is provided a method of forming a folded edge in an elongated strip of material, wherein the material is passed along a path in a vertically disposed manner, through a plurality of spaced apart edge forming roller means.

The successive roller means impart a characteristic bend or fold in an elongated edge of the strip to provide a total shaping operation, whereby there can be continuously or continually produced an elongated strip having a desired fold along an elongated edge.

It will be understood that the reference to the strip being vertically disposed or in a vertical disposition is intended to indicate that the major flat surfaces of the strip lie in a vertical plane, as distinct from a horizontally disposed strip in which the major flat surfaces lie in a horizontal plane, as in the aforementioned Canadian Patent.

The invention is especially concerned with an apparatus and method for conveniently and economically producing fascia, siding, other building panels and similar articles

BRIEF DESCRIPTION OF THE DRAWINGS

The invention is illustrated in a particular embodiment by reference to the accompanying drawings in which:

FIG. 5 illustrates schematically a detail of roller station A as an end elevation, FIG. 6 illustrates schematiclly a detail of roller station B in as isometric view, FIG. 7 illustrates schematically the successive bends or folds formed in the vertically disposed elongated strip, employing the machine of FIG. 1, as it is fed from a coil, FIG. 8 illustrates schematically a detail of a turntable mounting the coil shown in FIG. 7.

DESCRIPTION OF THE PREFERRED EMBODIMENTS

Figure 1:
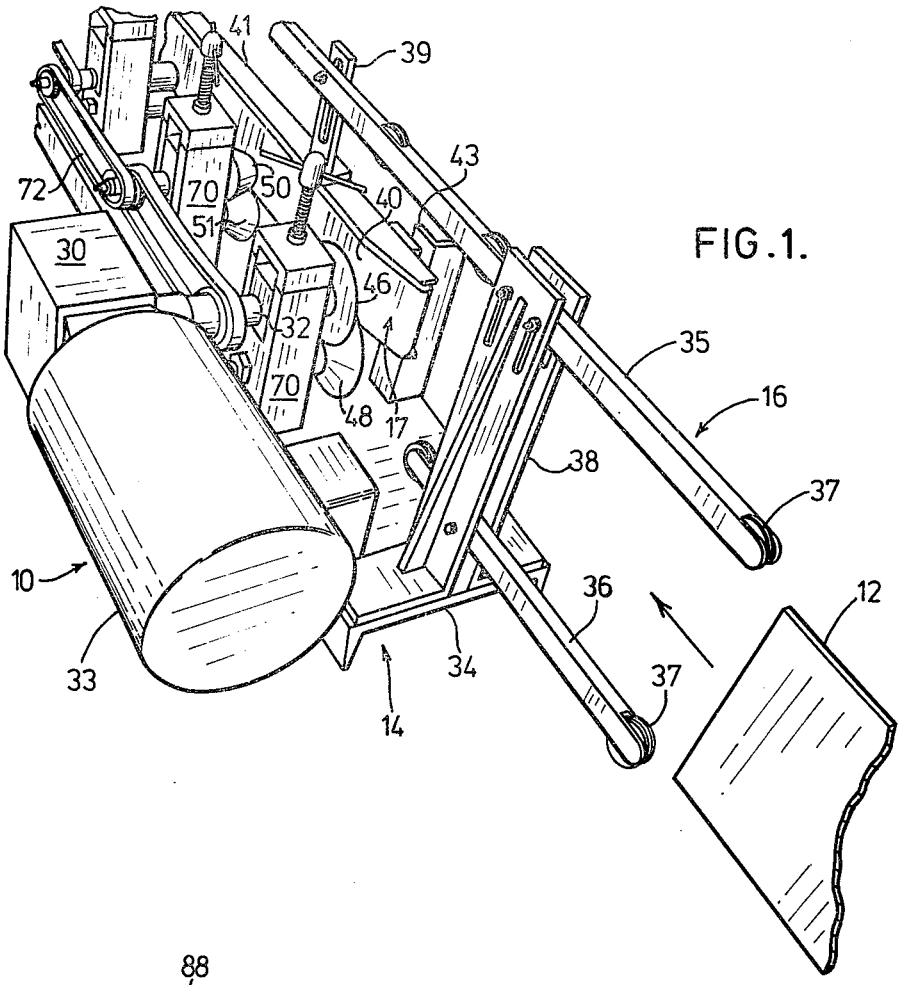
FIG. 1 is an isomeric view of the entry end of a machine of the invention about to be fed with an elongated strip of sheet material.
Figure 2:
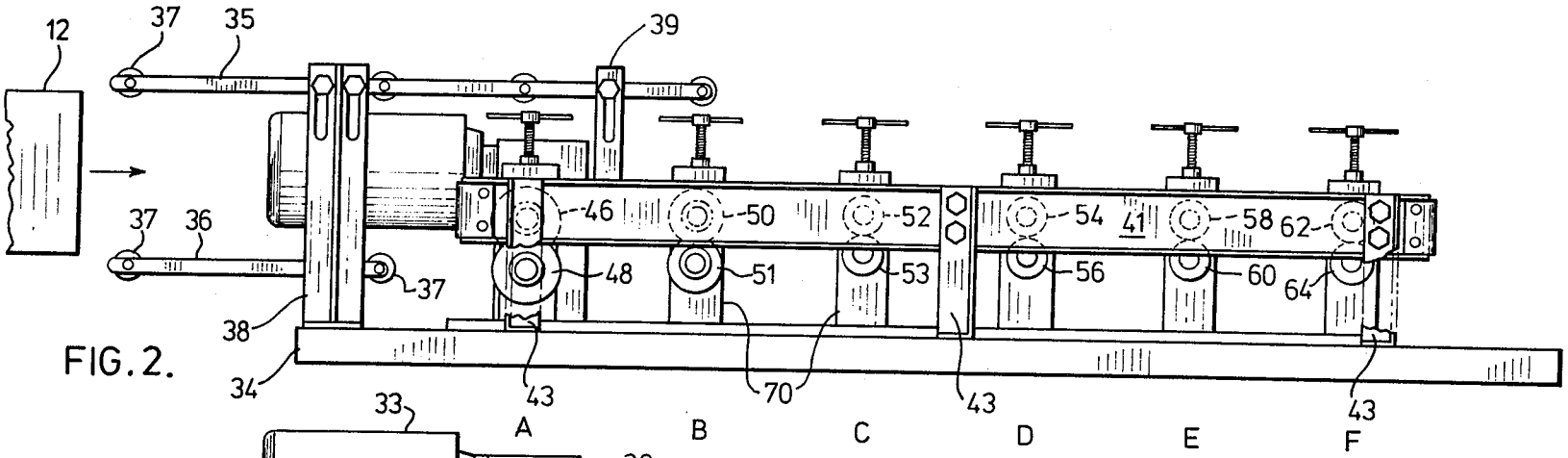
FIG. 2 is an elevation view of the machine of FIG. 1 as viewed from the rear of the view shown in FIG. 1.
Figure 3:
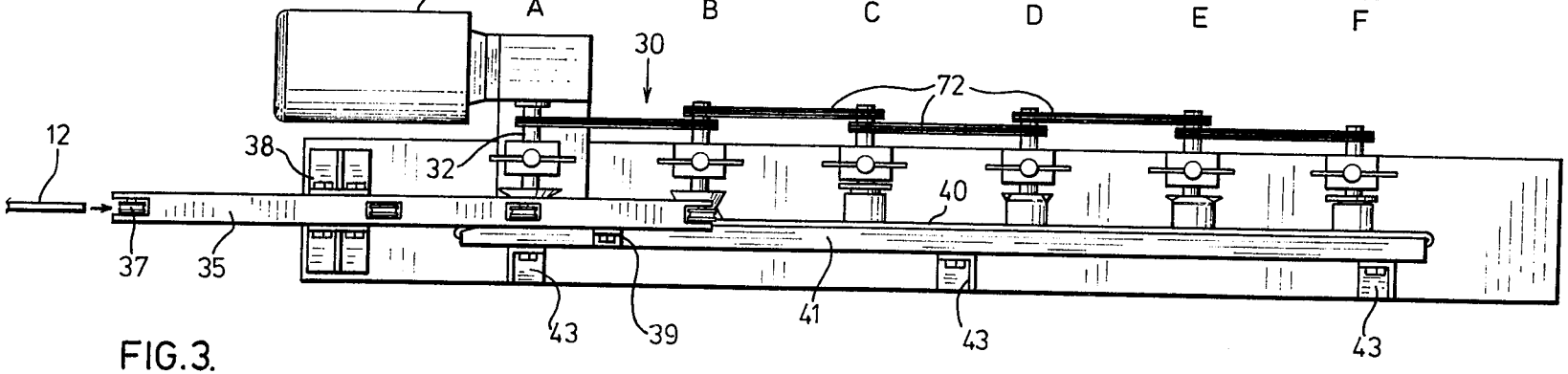
FIG. 3 is a top plan view of the machine, shown in FIG. 2.
Figure 9:
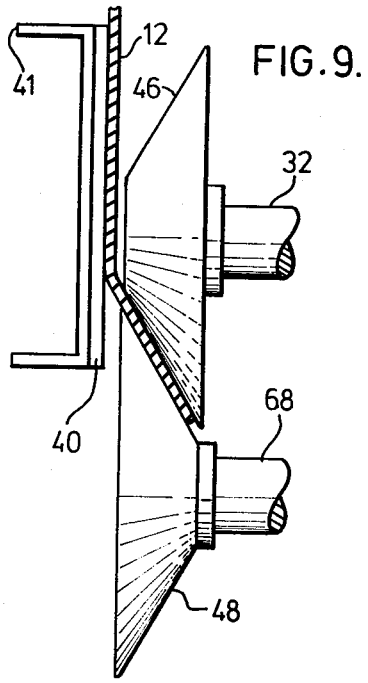
FIG. 9 illustrates schematically the operation of the first roller means of the sequence, in the machine of FIG. 1.
Figure 10:
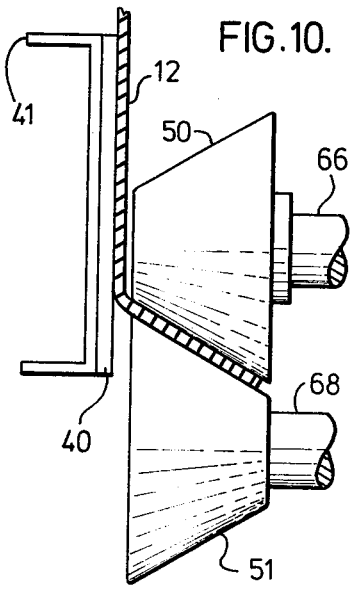
FIG. 10 illustrates schematically the operation of the second roller means of the sequence, in the machine of FIG. 1.
Figure 11:
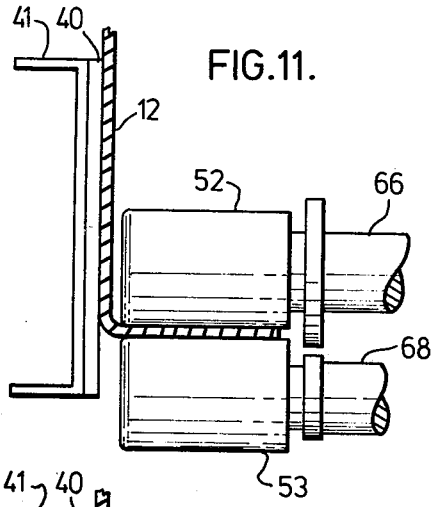
FIG. 11 illustrates schematically the operation of the third roller means of the sequence, in the machine of FIG. 1.
Figure 12:
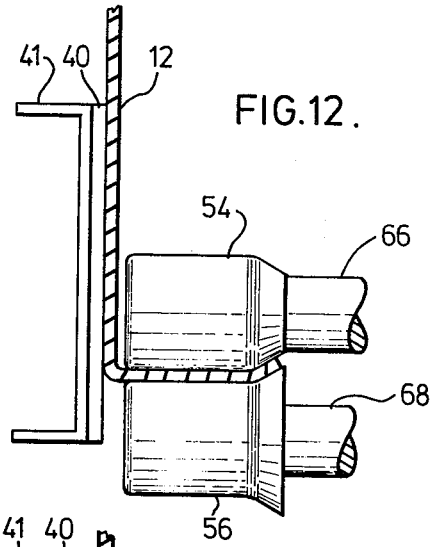
FIG. 12 illustrates schematically the operation of the fourth roller means of the sequence, in the machine of FIG. 1.
Figure 13:
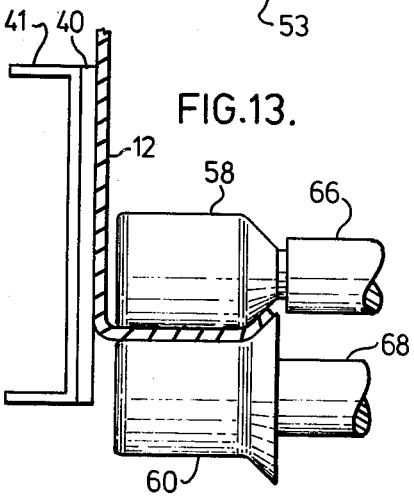
FIG. 13 illustrates schematically the operation of the fifth roller means of the sequence.
Figure 14:
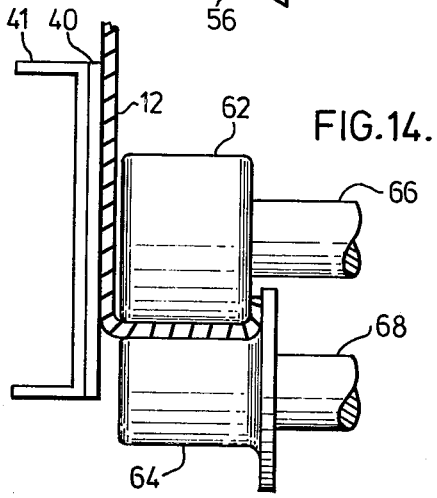
FIG. 14 illustrates schematically the operation of the sixth roller means of the sequence.

With further reference to the drawings, and in particular FIGS. 1, 2 and 3 there is shown a machine 10 for forming a folded edge in a strip 12 to produce fascia.

The machine 10 comprises a supporting frame 14, a feed guide 16, a support surface 17, roller stations A, B, C, D, E and F in a spaced apart arrangement, chain drive means 30, a drive shaft 32 and a motor 33.

The supporting frame 14 comprises a base 34, a vertical support member 38 at the entry end and spaced apart vertical support members 43, all mounted on base 34. An elongated horizontal support member 41 is mounted on members 43 and a vertical support member 39 is mounted on horizontal support member 41 adjacent the entry end of the machine.

The feed guide 16 includes an upper guide-bar 35 mounted on support members 38 and 39, and a lower guide-bar 36 mounted on support member 38. Guide rollers 37 are rotatably mounted in the guide-bars 35 and 36.

Support surface 17 includes an elongated felt pad 40 mounted on an inwardly facing surface of horizontal support member 41.

Each of roller stations A, B, C, D, E and F includes an upper roller and a lower roller designated 46 and 48; 50 and 51; 52 and 53; 54 and 56; 58 and 60; and 62 and 64 respectively.

Upper roller 46 of roller station A is mounted for rotation on the drive shaft 32. Upper rollers 50, 52, 54, 58 and 62 are rotatably mounted on central rotary support shafts 66 while lower rollers 48, 51, 53, 56, 60 and 64 are rotatably mounted on central rotary support shafts 68.

Each roller station further comprises an upstanding roller support 70 in which the shafts 32, 66 and 68 are rotatably mounted.

Chain drive means 30 includes a continuous chain 72 mounted between drive shaft 32 and support shaft 66 of roller station B; and additional continuous chains 72 mounted between the adjacent support shafts 66 of stations B and C; C and D; D and E; and E and F.

With further reference to FIGS. 5 and 6 there are shown details of roller stations A and B respectively. With particular reference to FIG. 6, an outer continuous chain 72, which is disposed between stations B and C, comprises a plurality of connected links 74, which engage teeth 76 in a toothed ring 78 mounted on the end of shaft 66. A second continuous chain 72 is shown inwardly of the aforementioned chain 72, and is similarly connected to drive shaft 32 of station A (the second toothed ring on shaft 66 in FIG. 6 is not shown).

Each roller support 70 includes an upper casing 80 which mates with a lower casing 82. A generally rectangular cavity 84 is defined between the casings 80 and 82. A generally rectangular block 86 is mounted in cavity 84 by means of a screw 88 engaging a threaded bore 90 in the upper casing 80, the screw 88 being keyed in block 86.

A vertically upright elongated pin 92 is mounted between an arcuate slot 94 in block 86 and an arcuate slot 96 in an inner wall of cavity 84 in lower casing 82.

With further reference to FIGS. 7 and 8 there is shown a convenient and simple means for the feeding of strip 12 in a vertical disposition as shown in FIGS. 1 and 2.

With reference to FIG. 7 there is shown a coil 98 of the material of strip 12 mounted on a turntable 100.

As shown in FIG. 8 the turntable 100 includes a platform 102 to support the coil 100. A shaft 106 extends downwardly from platform 2 and is mounted for rotation in a bearing 108 supported on a base 104.

With further reference to FIGS. 9 to 14 there is shown the successive bends or folds produced in a lower elongated edge of the strip 12 as it passes between the rollers of roller stations A to F. The folds or ends are further illustrated in a simplified manner in FIG. 7.

Figure 4:
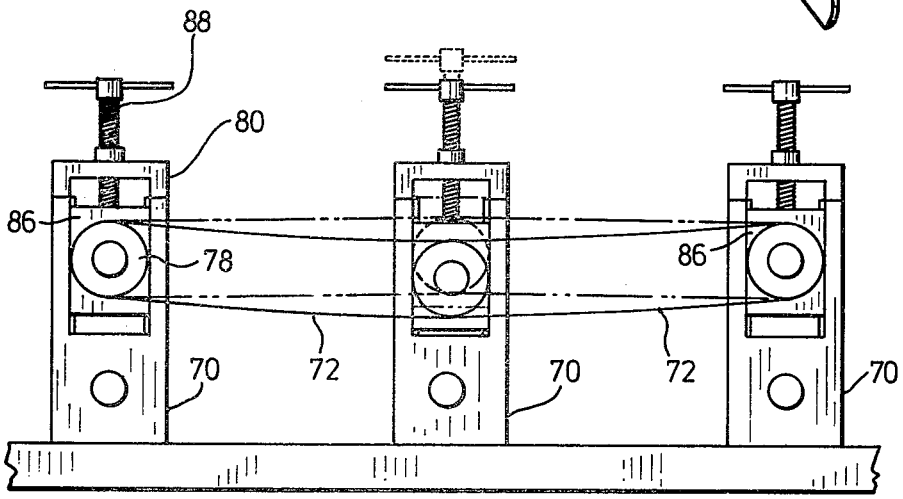
FIG. 4 illustrates schematically the drive means for the rollers and the vertical adjustability of the upper rollers.

By reference to FIGS. 4 and 6 it will be seen that the upper shaft 66 of each of roller station B to F, and the drive shaft 32 of roller station A may be raised or lowered by turning the screw 88 to move block 86 upwardly or downwardly in cavity 84 of the roller support 70. In this way the separation of the upper and lower rollers of each roller station can be adjusted to accommodate different thicknesses of strip 12.

In operation, and before the motor 33 is switched on, the drive shaft 32 of roller station A and the shafts 66 of stations B to F are initially raised by means of their respective screws 88, whereby the upper rollers 46, 50, 52, 54, 58 and 62 are lifted clear from the lower rollers 48, 51, 53, 56, 60 and 64 respectively.

The end of strip 12 is fed between the guide rollers 37 of the upper and lower guide-bars 35 and 36. This is done manually and causes the platform 102 of turntable 100 to rotate, whereby strip 12 is drawn from coil 98.

The strip 12 is fed between the upper and lower rollers of each of roller stations A to F. The screws 88 are adjusted to move the upper rollers of each of stations A to F downwardly so that the lower elongated edge of strip 12 is engaged between the upper and lower rollers of each of the roller stations A to F. The screws 88 should not be tightened, since undue pressure of the rollers on the strip 12 will mar the surface of the strip 12 and may cause cracks in a painted coating on the strip 12, or indeed in the metal. The strip 12 when seated between the upper and lower rollers is maintained in its vertical upright position by the felt pad 40 with which it is in contact (see FIGS. 9 to 14). The felt pad 40 prevents flexing of the strip 12 so that buckling and ripples are avoided during the subsequent passage of the strip 12 through the machine 10.

The motor 33 is switched on and this drives the drive shaft 32, which drives the shafts 66 of roller stations B to F, by means of the chain drive means 30.

In this way the upper roller of each of roller stations A to F is caused to rotate. The engagement of the upper rollers with the strip 12, and the engagement of the strip 12 with the lower rollers of each of roller stations A to F, is such that the lower rollers are caused to rotate in a direction opposite to the direction of rotation of the upper rollers and the strip 12 is drawn through the machine, through the rollers of the successive roller stations A to F.

A folding or bending operation is carried out at each roller station as illustrated in FIGS. 9 to 14, and the strip 12 emerges from roller station F with the completed fold along its lower edge.

The disposition of the rollers in the roller stations A to F is such as to define a substantially straight path for the strip 12.

The straight path in conjunction with the support provided by felt pad 40, which ensures that the strip 12 is maintained in a vertical position, avoids undue bending of the strip 12 which might cause buckles and which would necessitate discarding of lengths of the strip 12.

The motor 33 can be switched off at will by the operator so as to cut desired lengths of the folded strip emerging from the machine 10.

The machine 10 is simple in structure and compact and can be moved from place to place on a small trolley mounted on wheels. The turntable 100, likewise provides a simple means for feeding of the strip into the machine 10 and avoids the necessity of hoists to lift the coil 98 above the machine, and of space consuming upper supporting structure to mount the coil above the machine as in the aforementioned Canadian Pat. No. 983,366.

The position of upper guide-bar 35, mounted on vertical support members 38 and 39 is vertically adjustable whereby the separation of the upper and lower guide-bars 35 and 36, respectively can be adjusted to accommodate strips of different widths.

The vertical adjustability of the upper rollers of roller stations A to F permits adjustment in the separation of the upper and lower rollers to accommodate strips of different thicknesses.

The ability to modify the machine 10, by simple adjustment, to accommodate strips of different widths and thicknesses renders the machine 10 highly flexible in use and effects significant advantages over the conventional machines.

The necessary adjustment of the upper rollers of stations A to F to accommodate the strip 12 is readily determined by trial. The upper and lower rollers of each of roller stations A to F, in operation, frictionally engage the opposed flat surface of the strip 12 adjacent the lower elongated edge. The frictional engagement need only be that necessary for the rotating rollers to draw the strip 12 through the station A to F.

It will be understood, in connection with FIG. 6, that a second vertically upright elongated pin 92 is mounted between arcuate slots 94 and 96 in the side of the block 94 opposed to that visible in FIG. 6.

The machine 10 is compact and can be moved easily from site to site; it can be manufactured inexpensively, and there is ready access to all parts of the machine; this is to be contrasted with the rather complex arrangement as described in the aforementioned Canadian Patent.

The invention has been described in particular by reference to a machine for producing fascia, however, it will be understood that other building panels and similar articles can be produced within the invention. Different roller stations can be employed to impart different folds in the production of such panels and similar articles, particularly from aluminium or galvanized steel.

I claim:

1. An apparatus for forming a folded edge in an elongated, flat strip of material comprising:

a supporting structure, a plurality of edge forming roller means mounted in said supporting structure at spaced intervals along a straight path, said roller means being adapted to progressively impart a shaped edge in an elongated edge of said strip as said strip is passed along said path; and means for guiding said elongated strip in a vertical disposition along said path with a vertically disposed flat surface of said strip adjacent said elongated edge; said means for guiding comprising an elongated support surface extending adjacent said path and adapted to supportingly contact said vertically disposed flat surface of said strip and maintain it in said vertical disposition.

2. An apparatus for forming a folded edge in an elongated, flat strip of material comprising:

a supporting structure, a plurality of edge forming roller means mounted in said supporting structure at spaced intervals along a path, said roller means being adapted to progressively impart a shaped edge in an elongated edge of said strip as said strip is passed along said path; and means for guiding said elongated strip in a vertical disposition along said path with a vertically disposed flat surface of said strip adjacent said elongated edge, said means for guiding comprising an elongated stationary support surface mounted on said structure, extending adjacent said path and adapted to supportingly contact said vertically disposed flat surface of said strip and maintain it in said vertical disposition;

said path defining a straight line.

3. Apparatus according to claim 2, wherein said support surface comprises a supported felt pad effective to prevent flexing of the strip, whereby building and rippling in the strip are avoided.

4. Apparatus according to claim 2, wherein said means for guiding further includes upper and lower roller guide means mounted on said structure, adapted to engage upper and lower elongated edges of the vertically disposed strip, for feeding said strip to said roller means.

5. An apparatus for forming building panelling from an elongated strip of metal sheet material comprising a supporting structure, a plurality of aligned edge forming roller means mounted in said structure at spaced intervals, each roller means comprising an upper roller connected to drive means and a lower, freely rotatable, roller, a straight path for a vertically disposed elongated strip of sheet material being defined between the upper and lower rollers of said plurality, said roller means being adapted to progressively impart a shaped edge in a lower elongated edge of said strip, as said strip is passed along said path between upper and lower rollers of successive roller means, guide means for guiding said strip in a vertical disposition along said path including an elongated stationary support surface mounted in said structure, extending adjacent said path and adapted to supportingly contact a vertically disposed flat surface of said strip and maintain it in a vertical disposition, and upper and lower roller guide means mounted in said structure adapted to engage upper and lower elongated edges of the vertically disposed strip, for feeding the strip to the roller means along said path.

6. Apparatus according to claim 5, wherein each upper roller is mounted in said structure for independent vertical movement whereby separation of the upper and lower rollers can be adjusted to accommodate strips of different thickness.

7. Apparatus according to claim 6, wherein each of said upper rollers is mounted on a supporting shaft, and including a motor operatively connected to directly rotate the supporting shaft of one of said upper rollers, a plurality of continuous drive chains, each drive chain operatively connecting a pair of adjacent supporting shafts of adjacent upper rollers, whereby rotation of the supporting shaft of said one upper roller effects rotation of the other upper rollers.

8. Apparatus according to claim 9 wherein each said roller means is rotatably mounted in a roller support, each said upper roller being mounted in a vertically moveable block in said roller support.

9. Apparatus according to claim 5 wherein at least one of said roller guide means is vertically adjustable whereby the separation of said roller guide means can be adjusted to accommodate strips of different widths.

10. Apparatus according to claim 5 in combination with a turntable adapted to support a strip of sheet material wound in a coil for feeding said strip in a vertical disposition to said upper and lower roller guide means.

11. An apparatus for forming a folded edge in an elongated strip of metal sheet material comprising a supporting structure, a plurality of aligned edge forming roller means mounted in said structure at spaced intervals, each roller means comprising an upper roller and a lower roller, a straight path for a vertically disposed elongated strip of sheet material being defined between the upper and lower rollers of said plurality, said roller means being adapted to progressively impart a shaped edge in a lower elongated edge of said strip, as said strip is passed along said path between upper and lower rollers of successive roller means, guide means for guiding said strip in a vertical disposition along said path including an elongated stationary support surface mounted in said structure, extending adjacent said path and adapted to supportingly contact a vertically disposed flat surface of said strip and maintain it in a vertical disposition, and guide means mounted in said structure adapted to engage upper and lower elongated edges of the vertically disposed strip for feeding the strip to the roller means along said path.

12. An apparatus for forming a folded edge in an elongated strip of material comprising:

a supporting structure, a plurality of edge forming roller means mounted in said supporting structure at spaced intervals along a path, and guiding means for guiding said elongated strip in a vertical disposition along said path, said guiding means comprising an elongated stationary support surface comprising a supported felt pad mounted on said structure, and extending adjacent said path, said supported felt pad being adapted to supportingly contact a vertically disposed flat surface of said strip to prevent flexing of the strip whereby buckling and ripples in the strip are avoided and said vertical disposition is maintained.

13. A method of forming a folded edge in an elongated strip of material comprising:

passing the strip in a vertically disposed manner along a path, and progressively imparting a fold in an elongated edge of said strip in said path, while maintaining a flat surface of said strip adjacent said elongated edge vertically disposed, including supportingly contacting said flat surface with an elongated support surface extending adjacent said path to prevent flexing of the strip whereby buckling and ripples in the strip are avoided, and withdrawing a strip having a fold in an elongated edge and a flat surface free of buckles and ripples adjacent the folded edge.

14. A method of forming a folded edge in an elongated strip of material comprising:

passing the strip in a vertically disposed manner along a path, and progressively imparting a fold in an elongated edge of said strip in said path, while maintaining a flat surface of said strip adjacent said elongated edge vertically disposed, including supportingly contacting said flat surface with a stationary supported felt pad extending adjacent said path to prevent flexing of the strip whereby buckling and ripples in the strip are avoided, and withdrawing a strip having a fold in an elongated edge and a flat surface free of buckles and ripples adjacent the folded edge.

15. A method according to claim 11, wherein said fold is progressively imparted in said elongated edge by a plurality of spaced apart edge forming roller means along said path, comprising frictionally engaging said elongated edge with said roller means, and drawing said strip along said path by rotation of the rollers of said roller means, the fold being progressively imparted as the strip is drawn along said path between rollers of successive roller means.

16. A method according to claim 12, wherein said path defines a straight line.

* * * * *